US011357682B2

(12) United States Patent
Ribble et al.

(10) Patent No.: US 11,357,682 B2
(45) Date of Patent: Jun. 14, 2022

(54) STRUCTURES FOR CAUSING MOVEMENT OF ELEMENTS OF A BED

(71) Applicant: Hill-Rom Services, Inc., Batesville, IN (US)

(72) Inventors: David L. Ribble, Batesville, IN (US); Craig M. Meyerson, Syracuse, NY (US); Lori Zapfe, Milroy, IN (US); John V. Harmeyer, Cleves, OH (US); Xuan Teng, Batesville, IN (US); Jotpreet Chahal, Fayetteville, NY (US); Thomas F. Heil, Batesville, IN (US); Kirsten M. Emmons, Batesville, IN (US); David L. Bedel, Oldenburg, IN (US); Kenneth L. Lilly, West Chester, OH (US); Nicholas Mann, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 176 days.

(21) Appl. No.: 16/583,325

(22) Filed: Sep. 26, 2019

(65) Prior Publication Data

US 2020/0100962 A1 Apr. 2, 2020

Related U.S. Application Data

(60) Provisional application No. 62/739,337, filed on Sep. 30, 2018.

(51) Int. Cl.
*A61G 7/018* (2006.01)
*A47C 20/04* (2006.01)
(Continued)

(52) U.S. Cl.
CPC ..... *A61G 7/018* (2013.01); *A47C 20/048* (2013.01); *A47C 27/088* (2013.01); *A61G 7/015* (2013.01);
(Continued)

(58) Field of Classification Search
CPC ..... A61G 7/018; A61G 7/015; A61G 7/0525; A61G 2203/10; A47C 20/048; A47C 27/088
See application file for complete search history.

(56) References Cited

U.S. PATENT DOCUMENTS 948,644 A 2/1910 Bjornstad
1,610,898 A 12/1926 Steiner
(Continued)

FOREIGN PATENT DOCUMENTS

DE 1987293 A1 6/1968
JP S5438512 U 3/1979
(Continued)

OTHER PUBLICATIONS

Extended European Search Report, European Application No. 19200203.8, completed Nov. 20, 2019, (7 pages).

*Primary Examiner* — David R Hare
*Assistant Examiner* — Madison Emanski
(74) *Attorney, Agent, or Firm* — Barnes & Thornburg LLP

(57) ABSTRACT

The present disclosure is related to a bed assembly. Specifically, the present disclosure relates to a bed assembly that is compatible with a traditional consumer bed and can enhance the traditional consumer bed so it provides features of a traditional hospital bed. The bed assembly of the present disclosure may include pneumatic components to move portions of the bed assembly.

17 Claims, 10 Drawing Sheets

(51) Int. Cl.
*A47C 27/08* (2006.01)
*A61G 7/015* (2006.01)
*A61G 7/05* (2006.01)

(52) U.S. Cl.
CPC ..... *A61G 7/0525* (2013.01); *A61G 2203/10* (2013.01)

(56) References Cited

U.S. PATENT DOCUMENTS

| | | | | |
|---|---|---|---|---|
| 2,612,645 | A | | 10/1952 | Leslie |
| 2,887,692 | A | | 5/1959 | Berveir |
| 3,392,412 | A | | 7/1968 | Aymar |
| 3,426,373 | A | | 2/1969 | Scott et al. |
| 3,606,623 | A | | 9/1971 | Aymar et al. |
| 3,667,075 | A | | 6/1972 | Ballard |
| 3,781,928 | A | | 1/1974 | Swallert |
| 4,142,263 | A | | 3/1979 | Pierson |
| 4,150,284 | A | | 4/1979 | Trenkler et al. |
| 4,151,407 | A | | 4/1979 | Delagi et al. |
| 4,165,125 | A | | 8/1979 | Owen |
| 4,183,015 | A | | 1/1980 | Drew et al. |
| 4,216,462 | A | | 8/1980 | Digiacomo et al. |
| 4,225,953 | A | | 9/1980 | Simon et al. |
| 4,228,426 | A | | 10/1980 | Roberts |
| 4,237,344 | A | | 12/1980 | Moore |
| 4,298,863 | A | | 11/1981 | Natitus et al. |
| 4,309,783 | A | | 1/1982 | Cammack et al. |
| 4,331,953 | A | | 5/1982 | Blevins et al. |
| 4,527,298 | A | | 7/1985 | Moulton |
| 4,542,547 | A | | 9/1985 | Sato |
| 4,554,693 | A | | 11/1985 | Calloway |
| 4,577,185 | A | | 3/1986 | Andersen |
| 4,578,671 | A | | 3/1986 | Flowers |
| 4,593,273 | A | | 6/1986 | Narcisse |
| 4,598,275 | A | | 7/1986 | Ross et al. |
| 4,601,064 | A | | 7/1986 | Shipley |
| 4,649,385 | A | | 3/1987 | Aires et al. |
| 4,680,790 | A | | 7/1987 | Packard et al. |
| 4,814,751 | A | | 3/1989 | Hawkins et al. |
| 4,839,932 | A | | 6/1989 | Williamson |
| 4,850,040 | A | | 7/1989 | Teich et al. |
| 4,877,288 | A | | 10/1989 | Lee |
| 4,932,089 | A | | 6/1990 | Laviero |
| 4,955,000 | A | | 9/1990 | Nastrom |
| 4,967,195 | A | | 10/1990 | Shipley |
| 4,990,892 | A | | 2/1991 | Guest et al. |
| 4,998,095 | A | | 3/1991 | Shields |
| 4,998,939 | A | | 3/1991 | Potthast et al. |
| 5,012,539 | A | | 5/1991 | Grigg |
| 5,036,852 | A | | 8/1991 | Leishman |
| 5,060,174 | A | | 10/1991 | Gross |
| 5,062,151 | A | | 10/1991 | Shipley |
| 5,065,154 | A | | 11/1991 | Kaiser et al. |
| 5,086,290 | A | | 2/1992 | Murray et al. |
| 5,103,108 | A | | 4/1992 | Crimmins |
| 5,124,991 | A | | 6/1992 | Allen |
| 5,137,033 | A | | 8/1992 | Norton |
| 5,144,284 | A | | 9/1992 | Hammett |
| 5,153,584 | A | | 10/1992 | Engira |
| 5,170,522 | A | | 12/1992 | Walker |
| 5,184,112 | A | | 2/1993 | Gusakov |
| 5,195,198 | A | | 3/1993 | Travis |
| 5,253,656 | A | | 10/1993 | Rincoe et al. |
| 5,269,388 | A | | 12/1993 | Reichow et al. |
| 5,276,432 | A | | 1/1994 | Travis |
| 5,311,625 | A | * | 5/1994 | Barker ..... A47C 20/027 417/363 |
| 5,345,630 | A | | 9/1994 | Healy |
| 5,353,012 | A | | 10/1994 | Barham et al. |
| 5,415,167 | A | | 5/1995 | Wilk |
| 5,432,967 | A | | 7/1995 | Raftery |
| 5,490,295 | A | | 2/1996 | Boyd |
| 5,528,783 | A | | 6/1996 | Kunz et al. |
| 5,577,278 | A | | 11/1996 | Barker et al. |
| 5,621,931 | A | | 4/1997 | Hamilton |
| 5,715,548 | A | | 2/1998 | Weismiller et al. |
| 5,838,223 | A | | 11/1998 | Gallant et al. |
| 5,844,488 | A | | 12/1998 | Musick |
| 5,867,821 | A | | 2/1999 | Ballantyne et al. |
| 5,877,675 | A | | 3/1999 | Rebstock et al. |
| 5,933,488 | A | | 8/1999 | Marcus et al. |
| 5,936,539 | A | | 8/1999 | Fuchs |
| 5,942,986 | A | | 8/1999 | Shabot et al. |
| 5,944,659 | A | | 8/1999 | Flach et al. |
| 5,963,137 | A | | 10/1999 | Waters |
| 6,009,873 | A | | 1/2000 | Neviaser |
| 6,093,146 | A | | 7/2000 | Filangeri |
| 6,097,308 | A | | 8/2000 | Albert et al. |
| 6,111,509 | A | | 8/2000 | Holmes |
| 6,125,350 | A | | 9/2000 | Dirbas |
| 6,131,219 | A | | 10/2000 | Roberts |
| 6,133,837 | A | | 10/2000 | Riley |
| 6,142,592 | A | | 11/2000 | Grittke et al. |
| 6,183,417 | B1 | | 2/2001 | Geheb et al. |
| 6,208,250 | B1 | | 3/2001 | Dixon et al. |
| 6,397,416 | B2 | | 6/2002 | Brooke et al. |
| 6,684,425 | B2 | | 2/2004 | Davis |
| 7,154,397 | B2 | | 12/2006 | Zerhusen et al. |
| 7,568,246 | B2 | | 8/2009 | Weismiller et al. |
| 7,669,263 | B2 | | 3/2010 | Menkedick et al. |
| 7,690,059 | B2 | | 4/2010 | Lemire et al. |
| 7,852,208 | B2 | | 12/2010 | Collins, Jr. et al. |
| 8,536,990 | B2 | | 9/2013 | Collins, Jr. et al. |
| 8,656,541 | B2 | | 2/2014 | Muollo |
| 8,789,224 | B2 | | 7/2014 | Wyatt et al. |
| 2003/0041378 | A1 | | 3/2003 | Davis |
| 2003/0150058 | A1 | | 8/2003 | Davis |
| 2003/0196270 | A1 | | 10/2003 | Leventhal et al. |
| 2005/0114998 | A1 | * | 6/2005 | Leventhal ..... A47C 20/048 5/615 |
| 2006/0117482 | A1 | | 6/2006 | Branson |
| 2006/0123550 | A1 | | 6/2006 | Davis |
| 2006/0230539 | A1 | | 10/2006 | Goodman |
| 2008/0147442 | A1 | | 6/2008 | Warner et al. |
| 2016/0331616 | A1 | | 11/2016 | Fisk et al. |
| 2018/0333082 | A1 | | 11/2018 | Hoffman et al. |

FOREIGN PATENT DOCUMENTS

| | | | |
|---|---|---|---|
| JP | H01238859 | A | 9/1989 |
| JP | H04297257 | A | 10/1992 |
| WO | 2013134638 | A1 | 9/2013 |
| WO | 2014117128 | A1 | 7/2014 |

* cited by examiner

STRUCTURES FOR CAUSING MOVEMENT OF ELEMENTS OF A BED

PRIORITY CLAIM

This application claims priority under 35 U.S.C. § 119(e) to U.S. Provisional Application No. 62/739,337, filed Sep. 30, 2018, which is expressly incorporated by reference herein.

TECHNICAL FIELD

The present disclosure relates to a bed assembly for use during at-home care. More specifically, the present disclosure relates to a bed assembly that elevates the head section and foot section of a traditional consumer mattress.

BACKGROUND

The present disclosure is related to a bed assembly. Specifically, the present disclosure relates to a bed assembly that is compatible with a traditional consumer bed and can enhance the traditional consumer bed so it provides features of a traditional hospital bed. Such features include the ability to elevate the head section and foot section of the traditional consumer mattress using inflatable air bladders, contactless sensing of the occupant, and a siderail with integrated point-of-care monitoring.

Extended hospitalization of a patient is an ongoing challenge due to the high cost incurred by the patient and the hospital. At-home care is also challenging due to the high cost, difficulty, and complexity of equipping the home for patient care. While several systems and methods exist for equipping the home for patient care, opportunity exists for continued development in this area.

Still further, a need exists for an assembly for at-home use capable of providing a caregiver, such as a nurse, information regarding vital signs of a patient without requiring the caregiver to disturb the patient.

SUMMARY

The present disclosure includes one or more of the features recited in the appended claims and/or the following features which, alone or in any combination, may comprise patentable subject matter.

According to a first aspect of the present disclosure, a bed assembly comprises a frame, a mattress supported by the frame, and patient-care system. The patient-care system includes a support system and an elevation system and is positioned selectively between the frame and the mattress and configured to provide means for raising at least one movable section of the mattress from a fully-lowered position, in which the mattress is arranged generally parallel to the frame, to a fully-raised position, in which the at least one movable section of the mattress is arranged at an angle relative to the frame.

In some embodiments, the support system includes a top plate, a base plate, and a hinge positioned between a free end of the support system and a fixed end of the support system. The elevation system may be coupled to the support system and configured to move the support system to raise the at least one movable section of the mattress in response to an activation of the elevation system.

In some embodiments, the elevation system includes at least one pneumatic bladder positioned between the top plate and the base plate and at least one valve coupled to the at least one pneumatic bladder. The elevation system further includes at least one pneumatic actuator coupled to the at least one pneumatic bladder and configured to change the at least one pneumatic bladder from a deflated state to and inflated state to move the movable section of the mattress towards the fully-raised position.

In some embodiments, the at least one pneumatic actuator includes a housing, a canister of fluid, and an activator, the housing defines an internal space and the canister is positioned in the internal space and coupled to the pneumatic bladder with a conduit such that the canister is configured to release the fluid into the pneumatic bladder in response to triggering the activator. The pneumatic actuator may be a manual hand pump. The pneumatic actuator may be an automatic air-pump.

In some embodiments, the bladder has a sheet that defines an internal space and the elevation system further includes a foam insert positioned within the internal space of the bladder and the foam insert is configured to apply an outward force on the sheet to expand the bladder to the inflated state.

In some embodiments, the elevation system includes an inlet valve, an outlet value, and a valve cap configured to cover the outlet valve, and the inlet valve and the outlet valve are both one way valves such that the bladder is configured to remain inflated while the valve cap covers the outlet valve. The bladder is configured to deflate when the valve cap is removed from the outlet valve and a force is applied on the bladder and the foam insert to compress the foam insert.

In some embodiments, the elevation system includes a plurality of bladders each having a sheet that defines an internal space and plurality of foam inserts, at least one foam insert is positioned within the internal space of the bladders, and wherein each foam insert is configured to apply an outward force on the bladders to expand each bladder to the inflated state. The elevation system may further include at least one fastener between adjacent bladders to couple each of the bladders together.

In some embodiments, the elevation system includes a first pneumatic pump coupled to a first pneumatic bladder in a head section of the mattress and a second pneumatic pump coupled to a second pneumatic bladder in a foot section of the mattress, and the at least one valve is configured to open to manually release air contained within at least one of the pneumatic bladders.

In some embodiments, the elevation system includes a single pneumatic pump coupled to a first pneumatic bladder in a head section of the mattress and a second pneumatic bladder in a foot section of the mattress, and a first valve is configured to selectively switch between the first and second pneumatic bladders to inflate one of the first and second pneumatic bladders while a second valve is configured to open to manually release air contained within at least one of the pneumatic bladders.

In some embodiments, the bed assembly further includes a control panel and the elevation system includes a first pneumatic pump coupled to a first pneumatic bladder in a head section of the mattress and a second pneumatic pump coupled to a second pneumatic bladder in a foot section of the mattress, and a first valve is configured to open to manually deflate the first bladder upon activation of a first button on the control panel and a second valve is configured to open to manually deflate the second bladder upon activation of a second button on the control panel.

In some embodiments, the elevation system further includes a release system coupled to the pneumatic bladder, and wherein the valve is configured to allow fluid to flow out of the bladder at a first flowrate and the release system is configured to allow fluid to flow out of the bladder at a second flowrate, and the second flowrate is greater than the first flowrate. The release system includes a plug coupled to the pneumatic bladder and a cord having a first end coupled to the plug and a second end coupled to a pull tab.

In some embodiments, the elevation system includes a mount system and an actuator system. The mount system may include an upper mount coupled to the top plate and a lower mount coupled to the base plate. The actuator system includes a pair of left support links and a pair of right support links, the left support links coupled for pivotable movement relative to one another about a first support link axis, and the right support links coupled for pivotable movement relative to one another about a second support link axis.

In some embodiments, elevation system further includes an actuator mover coupled to the left support links and the right support links and is configured to move the first support link axis and the second support link axis toward one another to raise the top plate. The elevation system may further include an actuator mover coupled to the lower mount and configured to move the lower mount to raise and lower the top plate.

In some embodiments, the mount system includes a left support rod arranged on a left lateral side of the mattress, a right support rod arranged on a right lateral side of the mattress, and a connector rod underlying the mattress. The left support rod, the right support rod, and the connector rod may be telescopic.

In some embodiments, the actuator system includes an actuator, a belt, and a mount configured to secure the actuator and the belt to the left and right support rods. The belt is arranged to lie under a movable section of the mattress and the actuator is configured to actuate the belt to decrease a length of the belt and raise the movable section.

In some embodiments, the actuator mover includes a hand crank. The actuator mover may include a motor coupled to a power source.

In some embodiments, the support system further includes a cover having a first end and a second end spaced apart from the first end a predetermined distance so that a length of the cover corresponds to a elevation angle of the top plate relative to the base plate. The cover is configured to retain the top plate at the elevation angle to position the movable section of the mattress in the fully-raised position.

In some embodiments, the cover includes a sheet defining the length of the cover and at least one retainer coupled to the support system to fix the cover to the support system at the predetermined distance. The retainer includes longitudinal strips coupled to the support system and transverse strips coupled to the sheet, and a plurality of indicator marks are provided adjacent to the longitudinal strips. The indicator marks include a first set associated with a first angle of the mattress and a second set associated with a second angle of the mattress and the second end of the sheet is configured to align selectively with one of the sets to restrict the elevation angle of the mattress to one of the first and second angles associated with the first and second set.

According to another aspect of the present disclosure, an at-home bed assembly comprises a frame, a mattress supported by the frame, and a patient-care system. The patient-care system is positioned selectively above the mattress, the patient-care system including a pillow section and an elevation system, the elevation system configured to adjust at least one movable section from a fully-lowered position, in which the pillow section is arranged generally parallel to the frame and mattress, to a fully-raised position, in which the at least one movable section of the mattress is arranged at an angle relative to the frame and the mattress in response to a patient's body weight distribution on the patient-care system.

In some embodiments, the elevation system includes a primary bladder and a plurality of secondary bladders spaced apart from the primary bladder. A plurality of channels extend from the primary bladder to the secondary bladders to communicate fluid from the primary bladder to the secondary bladders.

In some embodiments, the secondary bladders include a head-section bladder, a foot-section bladder, and a pair of side-bolster bladders. Each of the head-section bladder, foot-section bladder, and side-bolster bladders is independently inflatable.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

Figure 1:
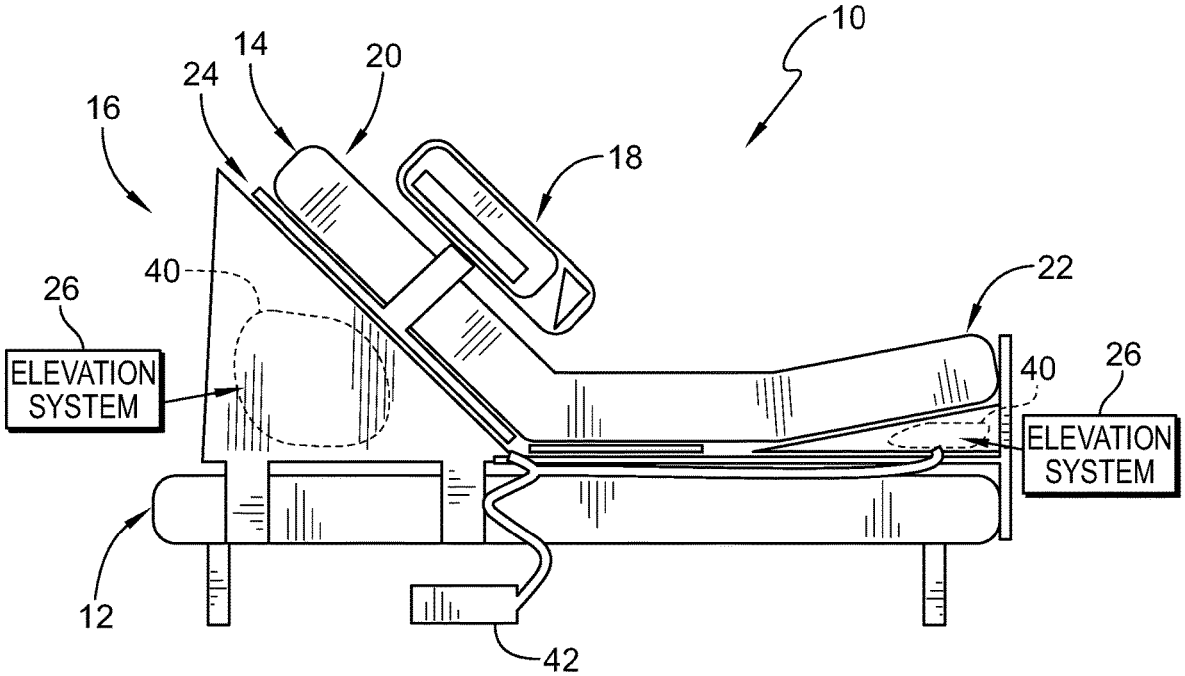
FIG. 1 is a perspective view of a bed assembly that includes a bed frame and a mattress supported on the bed frame.

An illustrative bed assembly 10 is shown in FIG. 1 and includes a frame 12 and a mattress supported by the frame 12. The patient support apparatus 10 is adapted for use in at-home patient care by providing a patient-care system 16. The patient care system 16 is configured to transform a conventional bed assembly into the bed assembly 10 to provide one or more bed functions that a patient may need while being treated for various medical conditions at home. As such, the patient-care system 16 includes a support system 24 and an elevation system 26 that are configured to move the mattress 14 relative to the frame 12 so that the mattress 14 may support a patient in multiple postures during at-home patient care. As previously described, the frame 12 and the mattress 14 illustratively provide a bed assembly that is used in a patient's home for personal uses. However, in other embodiments, the bed assembly 10 may be used in other settings such as, for example, a hospital, senior living/retirement homes, or any other suitable setting.

Illustratively, one such bed function provided by the patient care system 16 may be the raising and lowering of the head section 20, foot section 22, and/or other sections between the head section 20 and the foot section 22 of the mattress 14. As such, at least a portion of the patient-care system 16 is arranged to underlie the mattress 14 adjacent to movable sections of the mattress to provide the raising and lowering functions of the mattress 14. The support system 24 and the elevation system 26 are configured to cooperate to adjust a movable section, such as a head section 20 and a foot section 22, of the mattress 14 to an arrangement between a fully-lowered position, as shown in FIG. 2, and a fully-raised position, as shown in FIG. 3.

Figure 2:
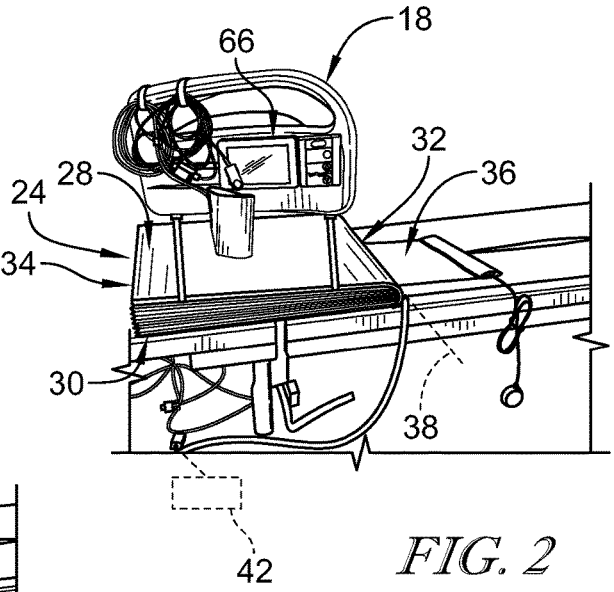
FIG. 2 is a perspective view of the bed assembly of FIG. 1 showing the mattress arranged generally parallel to the frame.
Figure 3:
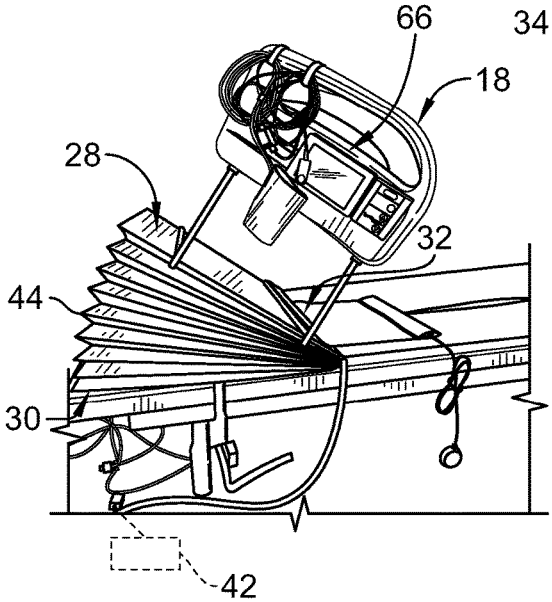
FIG. 3 is a perspective view of the bed assembly of FIG. 1 showing a movable section of the mattress arranged at an angle relative to the frame.

The support system 24 includes a top plate 28, a base plate 30, and a hinge 32 arranged between a free end 34 of the support system 24 and a fixed end 36 of the support system 24 as shown in FIGS. 2 and 3. The top plate 28 is relatively flat and is positioned under the mattress 14 in engagement with a movable section of the mattress 14. Illustratively, the top plate 28 engages the head section of the mattress 14 as shown in FIGS. 2 and 3. The base plate 30 is positioned below the top plate 28 in engagement with the frame 12 of the bed assembly 10. The hinge 32 is coupled to the top plate 28 and the base plate 30 at the fixed end 36 of the support system 24. The top plate 28 is coupled to the hinge 32 for pivotable movement about a support-system pivot axis 38 as the life generator 26 moves the support system 24 and the mattress 14 between the fully lowered position and the fully-raised position. The support system pivot axis 38 is provided by the hinge 32 at the fixed end 36 such that the top plate 28 moves away from the base plate 30 at the free end 34 while the top plate 28 remains generally fixed relative to the base plate 30 at the fixed end 36 as the support system 24 changes the mattress 14 from the fully-lowered position to the fully-raised position.

As described above, the elevation system 26 is configured to move the support system 24 to cause a movable section of the mattress 14 to change to various positions relative to the frame 12. The elevation system 26 is coupled to the support system 24 and provides a force on the support system 24 when activated to accomplish this objective. The force may be applied linearly on the support system 24, or the force may be applied on the support surface along a predetermined path.

A first embodiment of the elevation system 26, in accordance with the present disclosure, is illustratively shown in FIGS. 1-3. The elevation system 26 includes a pneumatic bladder 40 and a fluid source 42 coupled to the bladder 40. The bladder 40 is positioned between the top plate 28 and the base plate 30. The fluid source 42 is configured to provide fluid to the bladder 40 to fill the bladder 40 and cause the top plate 28 to move relative to the base plate 30. In this way, the movable section of the mattress 14 is elevated. In some embodiments, the bladder 40 may be wrapped in a cover 44 as shown in FIGS. 2 and 3 and described in greater detail below.

In the illustrative embodiment, a single pneumatic bladder 40 is provided between the top plate 28 and the base plate 30. However, in other embodiments, multiple bladders 40 may be used. Such bladder or bladders 40 may have any shape suitable to provide adequate force on the top plate 28 to cause the movable section of the mattress 14 to elevate.

In the illustrative embodiment, the fluid source 42 is configured to provide an air source to inflate the bladder 40. However, in other embodiments, any suitable fluid source may be used to inflate the bladder 40. The bladder 40 may be automatically inflated or deflated based on predetermined parameters. These parameters may be sensed by a series of sensors (not shown). The sensors may be coupled to a controller to determine if sensed values exceed predetermined thresholds that may require inflation or deflation of the bladder 40. One or more valves may be provided to allow fluid to flow selectively out of the bladder 40 so that the bladder 40 deflates as will be described in greater detail below.

Figure 4:
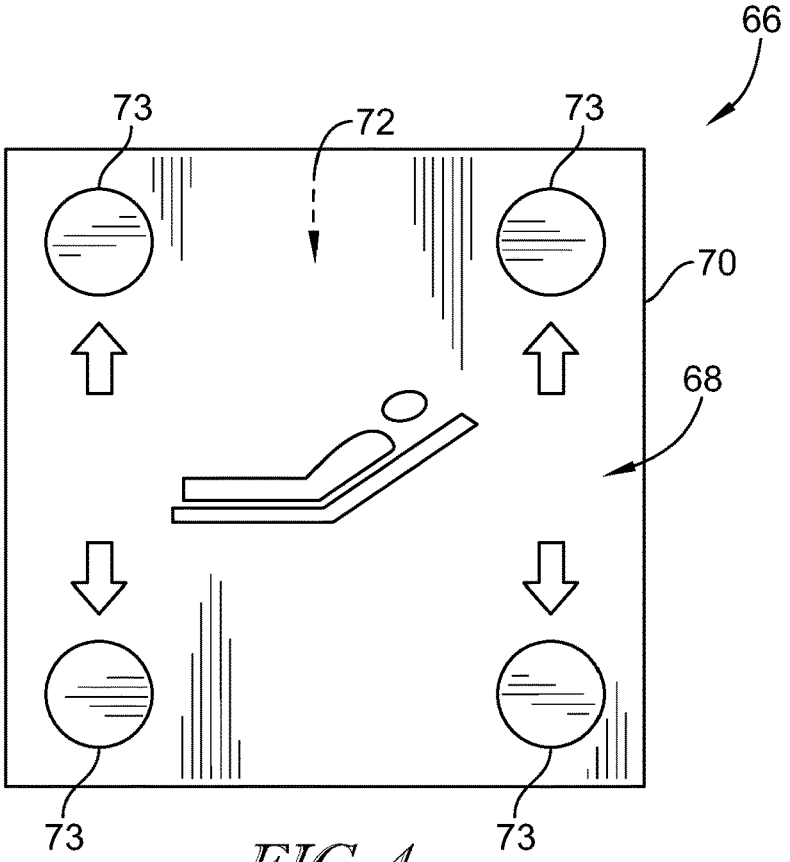
FIG. 4 is a front plan view of a control system for use with the bed assembly of FIG. 1.
Figure 5:
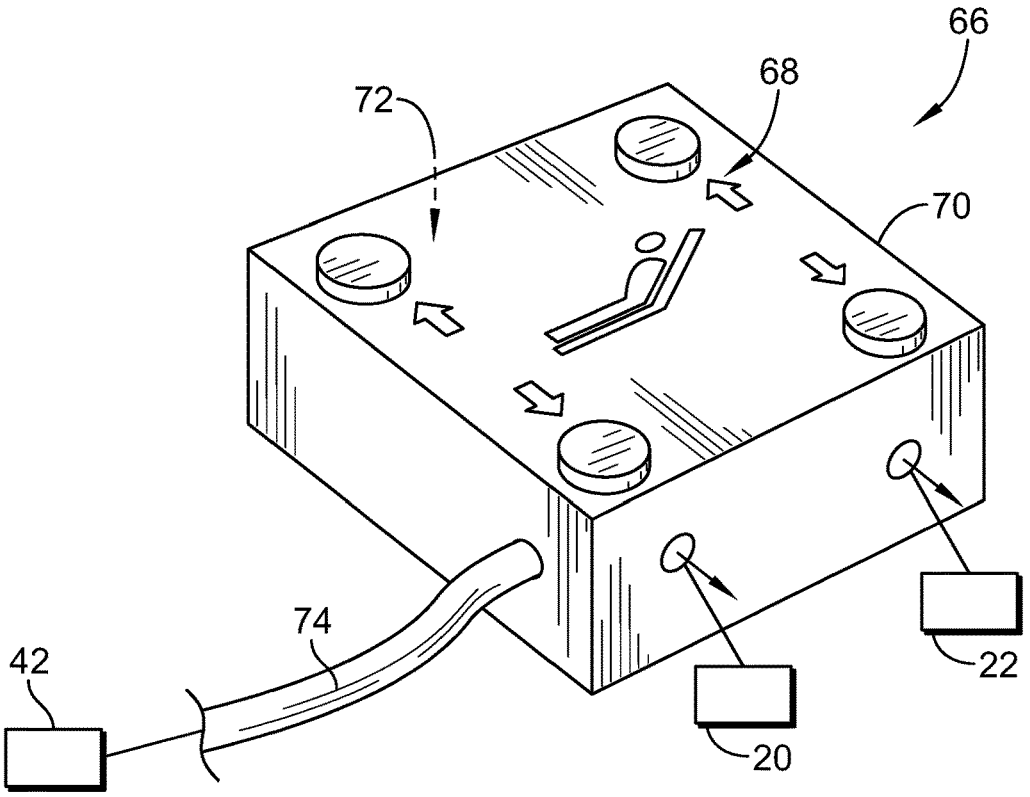
FIG. 5 is a perspective view of the control system of FIG. 4.
Figure 6:
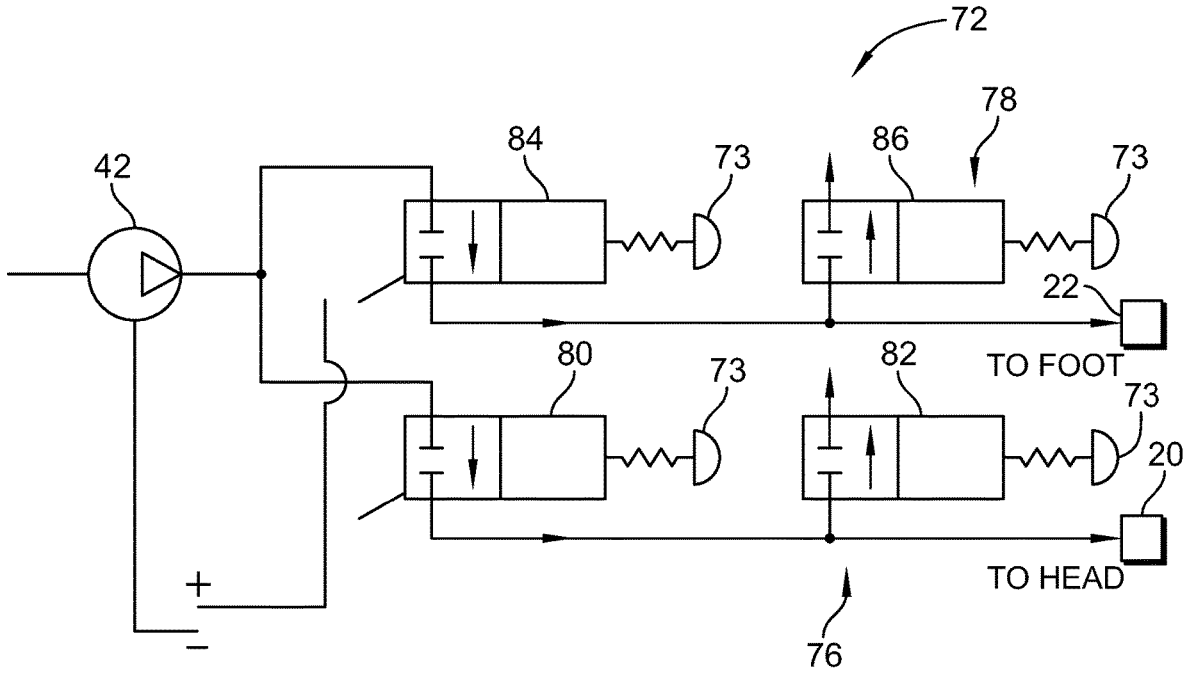
FIG. 6 is a schematic diagram of a valve circuit included in the control system of FIG. 4.

As shown in FIGS. 4-6, the patient-care unit 16 may further include a control system 66 configured to operate the elevation system 26. The control system 66 may be coupled to a collapsible siderail 18 as shown in FIG. 1 or another component of patient-care system 16 or remotely. The elevation system 26 may be activated via the control system 66 by a user such as, for example, a caregiver or the patient. However, in other embodiments, the elevation system 26 may be activated remotely or automatically in response to one or more predetermined conditions or settings of the patient-care system 16.

The control system 66 includes a control interface 68, a control housing 70, and a valve circuit 72 positioned within the control housing 70 as shown in FIGS. 4-6. The control interface 68 includes a plurality of switches 73 configured to be operated by the user to inflate and deflate the bladder 40 as indicated by arrows also included on the control interface 68. The valve circuit 72 is coupled to the fluid source 42 via a conduit 74 and the switches 73 and is configured to inflate or deflate a bladder 40 associated with one of the movable sections of the mattress 14 depending on the switch activated by the user.

A schematic illustration of an illustrative valve circuit 72 is shown in FIG. 6. The valve circuit 72 includes a head-section circuit 76 and a foot-section circuit 78. The head-section circuit 76 is configured to control raising and lowering of the head section 20 while the foot-section circuit 78 is configured to control raising and lowering of the foot section 22. In other embodiments, additional circuits may be provided to control raising and lowering of other sections of the mattress 14.

The head-section circuit 76 is coupled to the fluid source 42 and includes an inlet valve 80 and an outlet valve 82 as shown in FIG. 6. The head-section circuit 76 is configured to direct fluid from the fluid source 42 to the bladder 40 in the head section 20 when the switch 73 associated with the inlet valve 80 is actuated to inflate the bladder 40 and raise the head section 20. The head-section circuit 76 is configured to direct fluid out of the bladder 40 when the switch 73 associated with the outlet valve 82 is actuated to deflate the bladder 40 and lower the head section 20.

The foot-section circuit 78 is coupled to the fluid source 42 and includes an inlet valve 84 and an outlet valve 86 as shown in FIG. 6. The foot-section circuit 78 is configured to direct fluid from the fluid source 42 to the bladder 40 in the foot section 22 when the switch 73 associated with the inlet valve 84 is actuated to inflate the bladder 40 and raise the foot section 22. The foot-section circuit 78 is configured to direct fluid out of the bladder 40 when the switch 73 associated with the outlet valve 86 is actuated to deflate the bladder 40 and lower the foot section 22.

Figure 7:
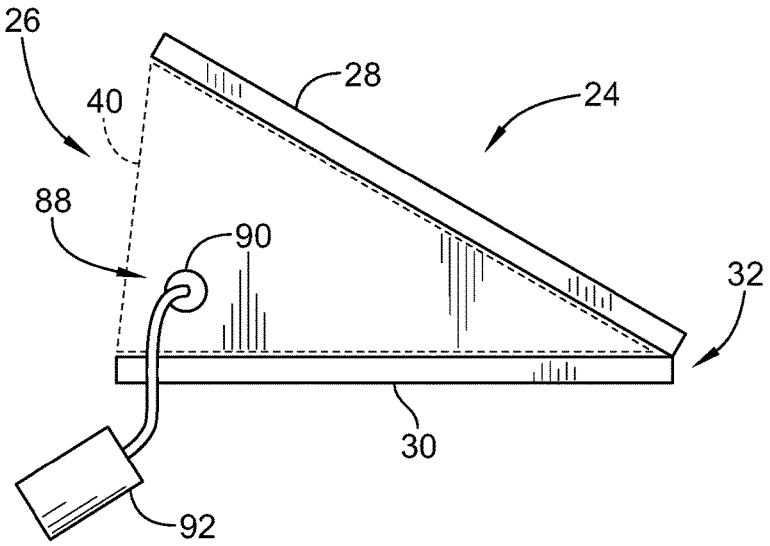
FIG. 7 is side elevation and diagrammatic view of an elevation system including an emergency-release system.

The valve circuit 72 may further include an emergency-release system 88 coupled to the bladder 40 as shown in FIG. 7. The emergency-release system 88 may be operated by a user in certain situations that may require the bladder 40 to deflate at a faster rate so that the patient lies flat on the patient support apparatus 10. The emergency-release valve 88 includes a plug 90 and a tether 92 coupled to the plug 90. The plug 90 is sized and positioned to cover an aperture in the bladder 40. The tether 92 may be pulled by a user to remove the plug from the bladder 40 so that the fluid in bladder 40 is released and the movable section of the mattress 14 is lowered at a faster rate.

Figure 8:
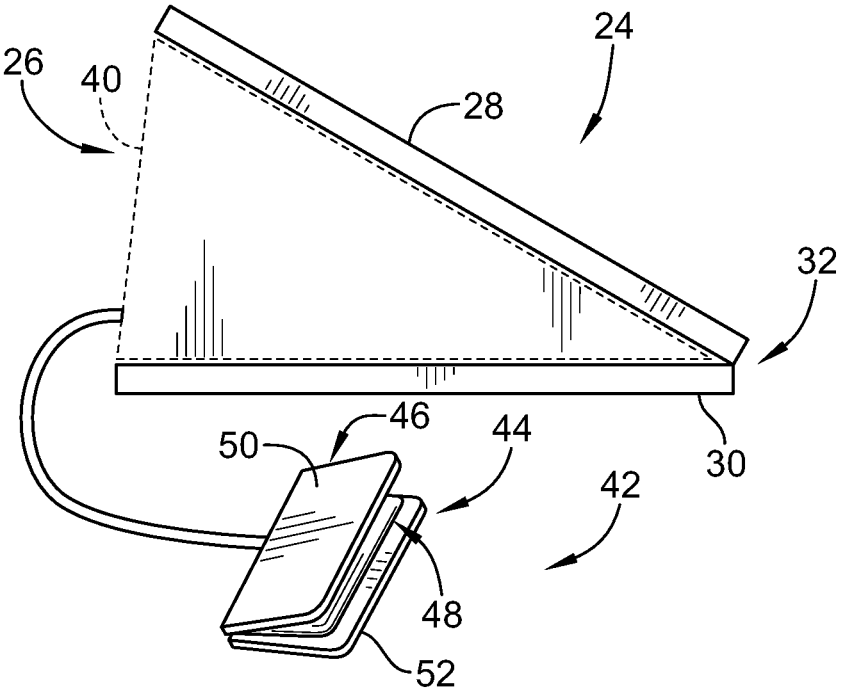
FIG. 8 is a side elevation and diagrammatic view of an elevation system of the bed assembly of FIG. 1.
Figure 9:
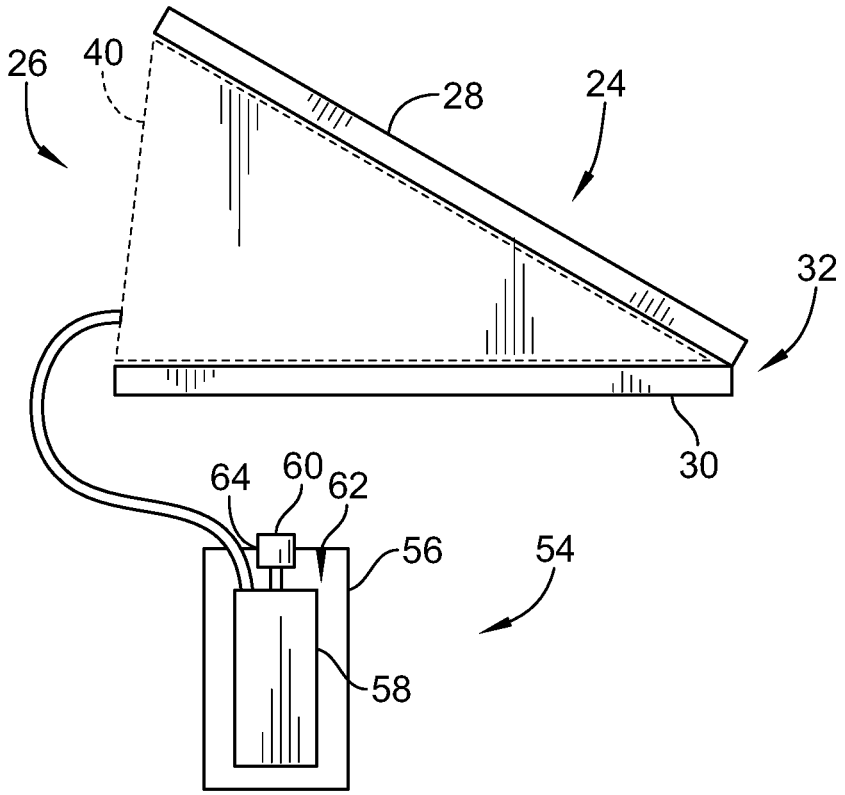
FIG. 9 is a side elevation and diagrammatic view of another elevation system of the bed assembly of FIG. 1.

Referring now to FIGS. 8 and 9, various types of fluid sources may be used to provide a flow of fluid to the bladder 40. The fluid source 42 may include a pump 44 as shown in FIG. 8. In the illustrative embodiment, the pump 44 is a hand pump 44 that is configured to be operated manually by a caregiver or the patient. In some embodiments, the pump 44 may include an automatic pump such as, for example, a diaphragm pump, a centrifugal pump, a displacement pump, a vacuum, or any other suitable pump.

The hand pump 44 includes a housing 46 and a diaphragm 48 positioned in a space defined by the housing 46 as shown in FIG. 8. The housing 46 includes a top plate 50 and a base plate 52. The diaphragm 48 provides a force on the housing 46 that maintains spacing between the top plate 50 and the base plate 52. The diaphragm 48 defines an internal space that holds fluid when the top plate 50 and the base plate 52 are spaced apart from one another. The caregiver or the patient may fill bladder 40 with fluid by applying an opposite force on the housing 46 to compress the diaphragm 48 causing the fluid in the internal space to flow out of the diaphragm and in to the bladder 40.

Referring now to FIG. 9, another illustrative embodiment of a fluid source 54 is shown. The fluid source 54 includes a housing 56, an air canister 58, and an activator 60. The housing 56 is shaped to define an internal space 62. The air canister 58 is arranged to fit in the internal space 62 of the housing 56. An aperture 64 is provided in the housing 56 and the activator 60 is sized to fit in the aperture 64. The activator 60 extends from the canister 58 in the internal space 62 through the aperture 64 to be accessed by a caregiver or the patient. To inflate the bladder 40, the caregiver or patient may actuate the activator 60 by compressing the activator 60 toward the canister 58. Compressed air is then released from the canister 58 to the bladder 40 to inflate the bladder 40. Depleted canisters 58 may be discarded or refilled and reused in the fluid source 54.

Figure 10:
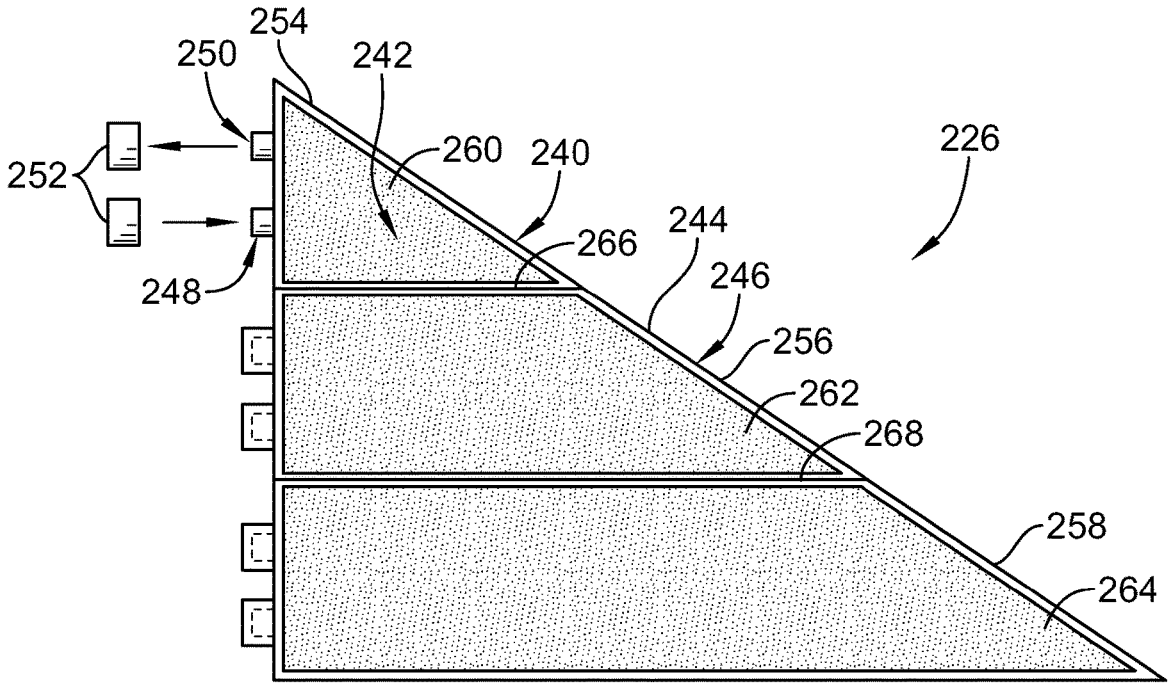
FIG. 10 is a side elevation and diagrammatic view of another elevation system of the bed assembly of FIG. 1.

Referring now to FIG. 10, another embodiment of an elevation system 226 is shown. The elevation system 226 includes a bladder 240 and a foam insert 242. The bladder 240 has a sheet 244 that is shaped to define an internal space 246. The foam insert 242 is positioned in the internal space 246 and has a shape that matches the shape of the internal space 246 defined by the sheet 244 when the bladder 240 is inflated.

The bladder 240 further includes an inlet valve 248 and an outlet valve 250 coupled to the sheet 244 as shown in FIG. 10. In the illustrative embodiment, the inlet valve 248 is a one-way valve and is configured to permit air to flow into the internal space 246 as the bladder 240 inflates. In the illustrative embodiment, the outlet valve 250 is a one-way valve and is configured to permit air to flow out of the internal space 246 as the bladder 240 deflates. Caps 252 are secured to the valves 248, 250 to block airflow into and out of the internal space 246. In other embodiments, a two-way valve may be used such that only one valve and cap is provided.

The foam insert 242 is made from any suitable foam material such as, for example, polyethylene or polyurethane. The foam insert 242 is configured to provide an outward force on the sheet 244. A caregiver or patient may raise and lower the movable section of the mattress 14 by removing selectively one or both of the caps 252 covering the valves 248, 250. For example, the outward force provided by the foam insert 244 maintains the bladder 240 in an inflated state when the cap 252 covering the inlet valve 248 is removed. The caregiver or patient may remove the cap covering the outlet valve 250 and apply an opposite force on the bladder 240 and the foam insert 242 to deflate the bladder 240. Once the movable section of the mattress 14 is arranged at the desired angle, both caps 252 may be resecured to the valves 248, 250 to block further ingress/egress of air to/from the internal space 246 of the sheet 244. In other embodiments, fluid source 42 or 54 may be used to help inflate and/or deflate the bladder 240. In other embodiments, a vacuum (not shown) may be used to provide suction to remove fluid from the bladders.

In the illustrative embodiment, the bladder 240 is divided into a first bladder section 254, a second bladder section 256, and a third bladder section 258 by respective dividers 266 and 268 as shown in FIG. 10. The foam insert 242 is also divided into a first foam section 260, a second foam section 262, and a third foam section 264, which are positioned within the first, second, and third bladder sections, respectively. Each foam section is separated from one another by a first divider 266 between the first and second foam sections and a second divider 268 between the second and third foam sections.

The dividers 266, 268 are coupled to the sheet 244 of the bladder 240 such that bladder sections are independent of one another. Additionally, an inlet valve 248 and an outlet valve 250 are coupled to each bladder section 254, 256, 258. In this way, each bladder section may be inflated and deflated independently of the other bladder sections to allow for more adjustment of the movable section of the mattress 14. Although three bladder sections and three foam sections are included in elevation system 226, it should be appreciated that any suitable number of bladder sections and foam sections may be used.

Figure 11:
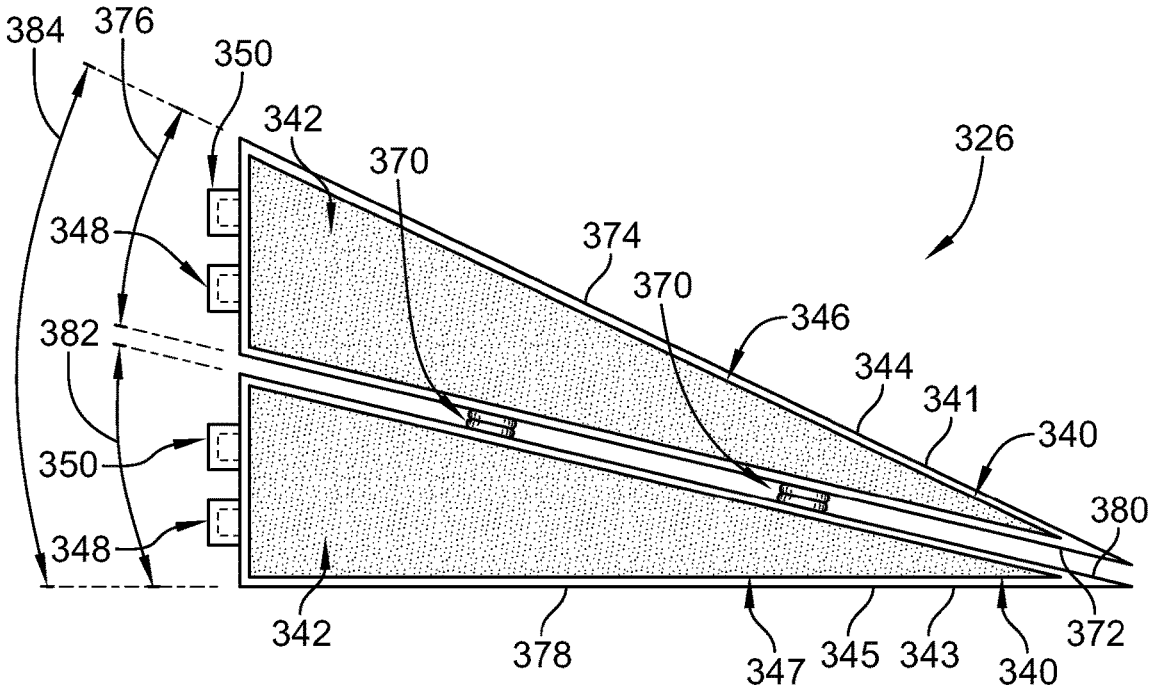
FIG. 11 is a side elevation and diagrammatic view of another elevation system of the bed assembly of FIG. 1.

Referring now to FIG. 11, another embodiment of an elevation system 326 is shown. Elevation system 326 is similar to elevation system 226 except elevation system 326 includes a plurality of bladders 340 that are configured to couple selectively to one another to increase an elevation angle of the movable section of the mattress 14. As such, similar reference numbers are used to describe features of elevation system 326 that are similar to elevation system 226.

The elevation system 326 includes a first bladder 341, a second bladder 343 and a plurality of foam inserts 342. Each bladder 341, 343 includes a sheet 344, 345 that are shaped to define internal spaces 346, 347. The foam inserts 342 are positioned in respective internal spaces 346, 347 and each has a shape that matches the shape of the internal spaces 346, 347 defined by the sheets 344, 345 when the bladders 341, 343 are inflated.

The first bladder 341 includes a bottom surface 372 and a top surface 374 that is angled relative to the bottom surface by an angle 376. The second bladder 343 includes a bottom surface 378 and a top surface 380 that is angled relative to the bottom surface by an angle 382. The first and second bladders 341, 343 are stacked to increase a total angle 384 of the elevation system 326 that corresponds to the elevation angle of the movable section of the mattress 14. In the illustrative embodiment, angle 376 is equal to angle 382, however, in other embodiments, the angle 376 may not be equal to angle 382. It should be appreciated that additional bladders 340 may be added to elevation system 326 to further increase the elevation angle of the movable section of the mattress 14.

Each bladder 341, 343 further includes an inlet valve 348 and an outlet valve 350 coupled to the sheets 344, 345 as shown in FIG. 11. In the illustrative embodiment, the inlet valves 348 and the outlet valves 350 cooperate with the foam inserts 342 to allow a caregiver or the patient inflate and deflate the bladders 341, 343 in the same way described above relating to elevation system 226. In some embodiments, fluid source 42 or 54 may be used to help inflate and/or deflate the bladders 341, 343. In other embodiments, a vacuum (not shown) may be used to provide suction to remove fluid from the bladders.

The elevation system 326 further includes fasteners 370 that are configured to couple the first bladder 341 to the second bladder 343 as shown in FIG. 11. In the illustrative embodiment, the fasteners 370 are mechanical fasteners such as, for example, snaps. However, in other embodiments, the fasteners 370 may include any suitable coupling means such as, for example, a cover, Velcro®, adhesives, or magnets.

Figure 12:
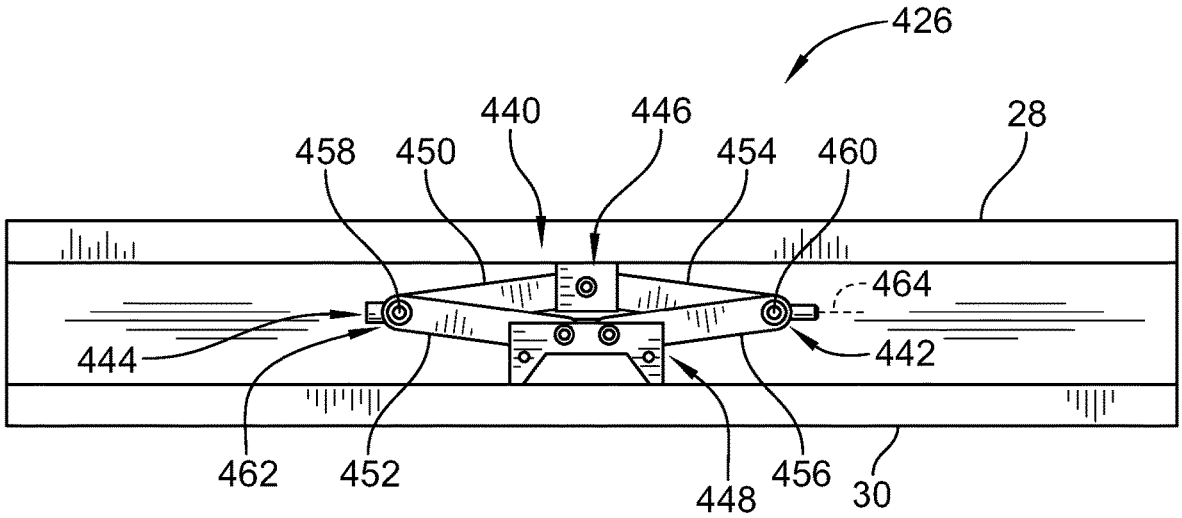
FIG. 12 is a rear elevation and diagrammatic view of another elevation system of the bed assembly of FIG. 1.
Figure 13:
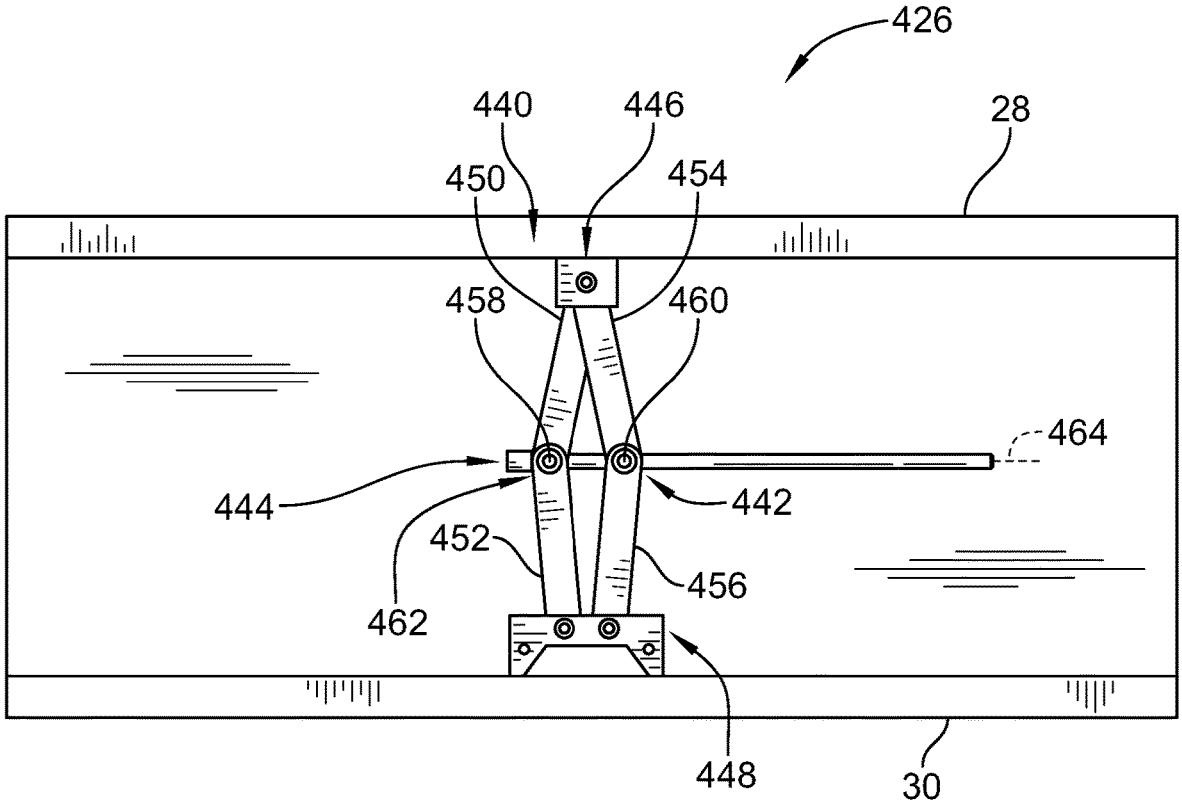
FIG. 13 is a rear elevation and diagrammatic view of the elevation system of FIG. 12 showing the elevation system extended.

Another embodiment of an elevation system 426, in accordance with the present disclosure, is shown in FIGS. 12 and 13. The elevation system 426 is a mechanical elevation system 426 and includes a mount system 440, an actuator system 442, and an actuator mover 444. The mount system 440 has an upper mount 446 coupled to the top plate 28 and a lower mount 448 coupled to the base plate 30. The actuator system 442 is configured to move the top plate 28 relative to the base plate 30 to raise and lower a movable section of the mattress 14. The actuator mover 444 is coupled to the actuator system 442 and is configured to move the actuator system 442 to cause the raising and lowering of the movable section of the mattress 14.

The mount system 440 couples the actuator system 442 to the top plate 28 and the base plate 30 as shown in FIG. 12. The actuator system 442 includes a pair of left support links 450, 452 and a pair of right support links 454, 456. Support links 450, 454 are coupled to the upper mount 446 while support links 452, 456 are coupled to lower mount 448. Support links 450, 452 are pivotably mounted to one another about a first link-pivot axis 458. Support links 454, 456 are pivotably mounted to one another about a second link-pivot axis 460.

The actuator mover 444 extends transversely from the left link-pivot axis 458 to the right link-pivot axis 460 as shown in FIGS. 12 and 13. The actuator mover 444 includes a mount 462 fixed near the left link-pivot axis 458 and threads that run along a length of the actuator mover 444. The actuator mover 444 is threadingly engaged to the pair of left support links 450, 452 and the pair or right support links 454, 456. The actuator mover 444 may be rotated about axis 464 to raise and lower the top plate 28 relative to the base plate 30. The left link-pivot axis 458 and the right link pivot axis 460 move toward one another as the actuator mover 444 is rotated to raise the top plate and move away from one another as the actuator mover 444 is rotated oppositely to lower the top plate 28.

Figure 14:
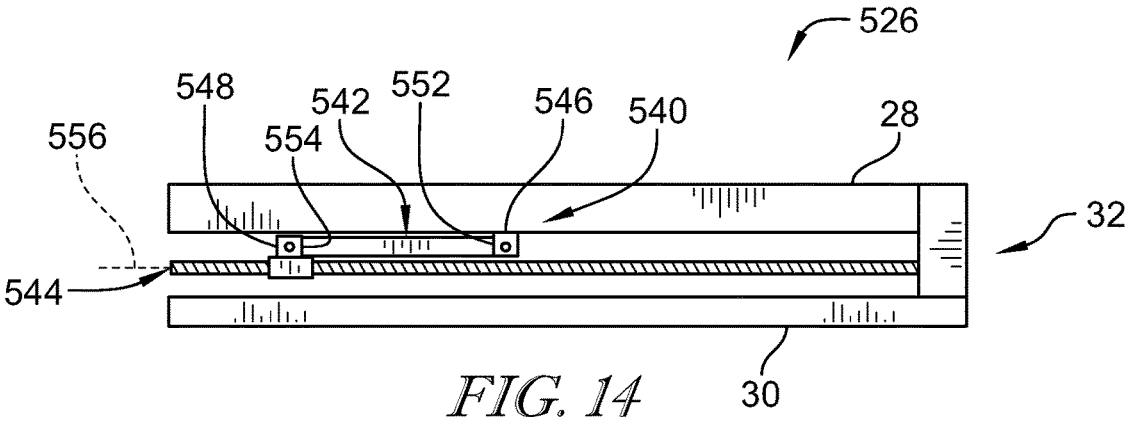
FIG. 14 is a side elevation and diagrammatic view of another elevation system of the bed assembly of FIG. 1.
Figure 15:
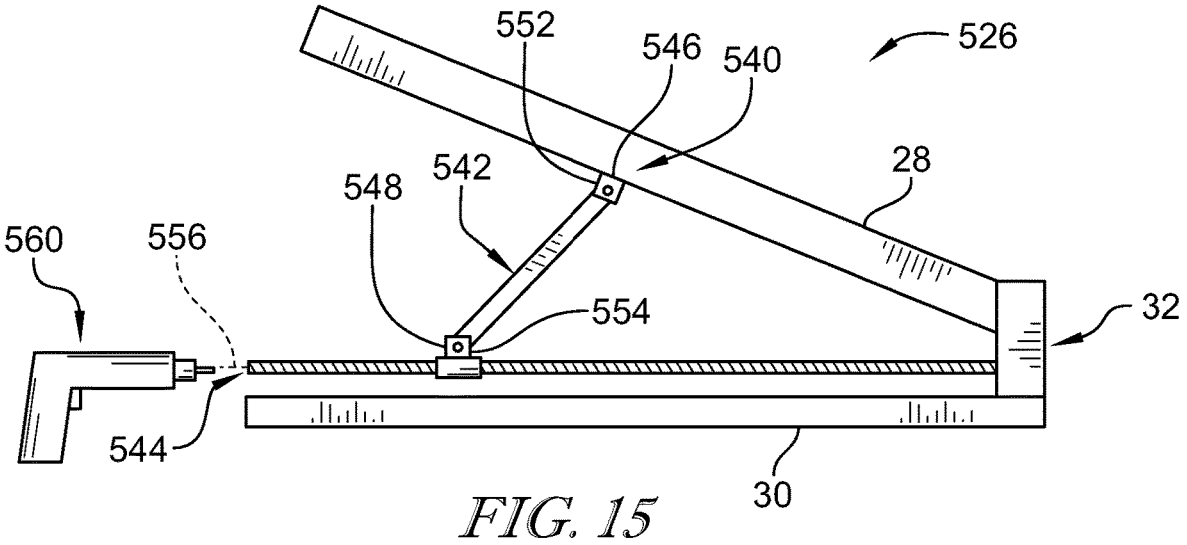
FIG. 15 is a side elevation and diagrammatic view of the elevation system of FIG. 14 showing the elevation system extended using a powered device.
Figure 16:
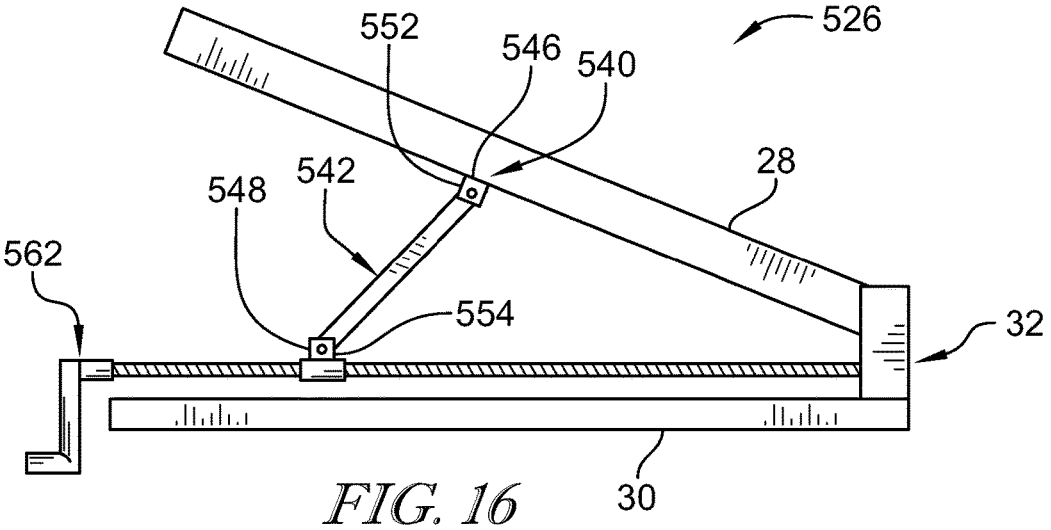
FIG. 16 is a side elevation and diagrammatic view of the elevation system of FIG. 14 showing the elevation system extended using a hand crank.

Another embodiment of an elevation system 526, in accordance with the present disclosure, is shown in FIGS. 14-16. The elevation system 526 is a mechanical elevation system 526 and includes a mount system 540, an actuator system 542, and an actuator mover 544. The mount system 540 has an upper mount 546 coupled to the top plate 28 and a lower mount 548 coupled to the base plate 30. The actuator system 542 is configured to move the top plate 28 relative to the base plate 30 to raise and lower a movable section of the mattress 14. The actuator mover 544 is coupled to the mount system 540 and is configured to move the mount system 540 and the actuator system 542 to cause the raising and lowering of the movable section of the mattress 14.

The mount system 540 couples the actuator system 542 to the top plate 28 and the base plate 30 as shown in FIG. 14. The upper mount 546 is fixed to the top plate 28. The lower mount 548 is threadingly mounted to the actuator mover 544. The actuator system 542 includes one or more support links that have a first end 552 coupled to the upper mount 546 and a second end 554 coupled to the lower mount 548.

The actuator mover 544 is configured to rotate about a actuator-mover axis 556 to raise or lower the top plate 28 relative to the base plate 30 depending on the rotation direction. The actuator mover 544 rotates to move the second end 554 of the actuator system 542 and the lower mount 548 toward the fixed end 36 of the support system 24 to raise the top plate 28 and thus movable section of the mattress 14. The actuator mover 544 rotates oppositely to move the second end 554 of the actuator system 542 and the lower mount 548 away from the fixed end 36 of the support system 24 to lower the top plate 28 and thus movable section of the mattress 14.

The actuator mover 544 may be rotated by a powered device 560 such as, for example, a drill or a motor as shown in FIG. 15. The actuator mover 544 may also be rotated manually by a device 562 such as, for example, a hand crank. In other embodiments, any suitable device or method for rotating the actuator mover 544 may be used.

Figure 17:
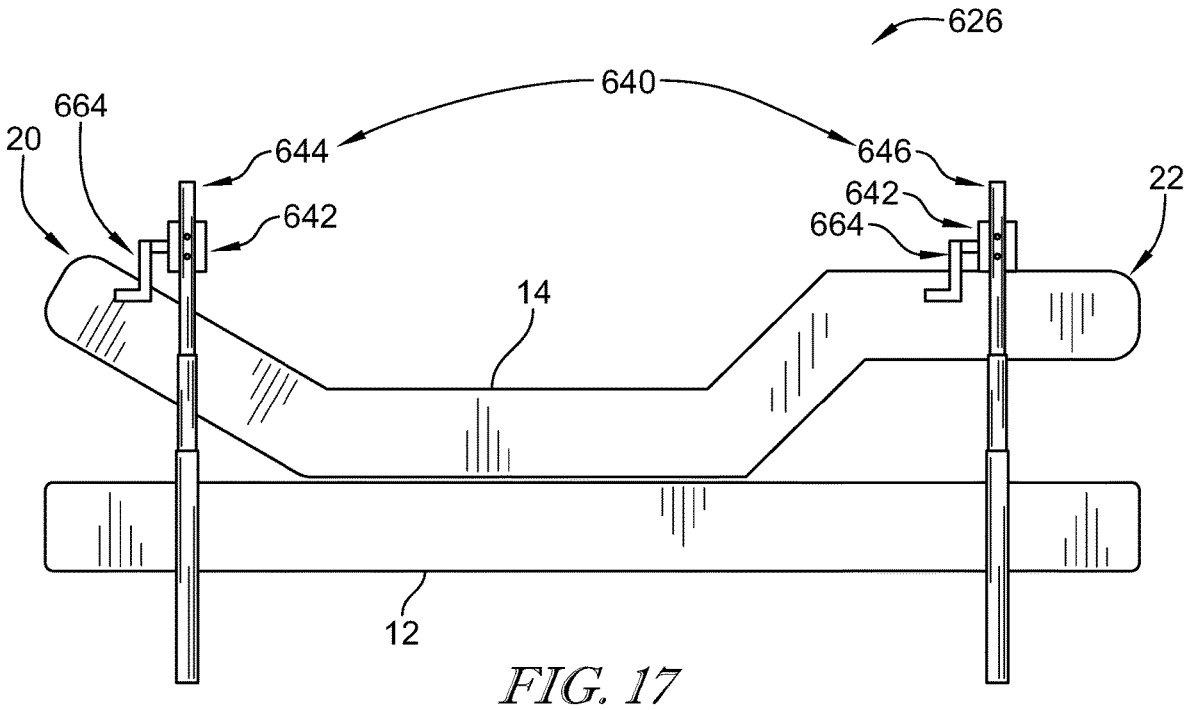
FIG. 17 is a side elevation and diagrammatic view of another elevation system of the bed assembly of FIG. 1.
Figure 18:
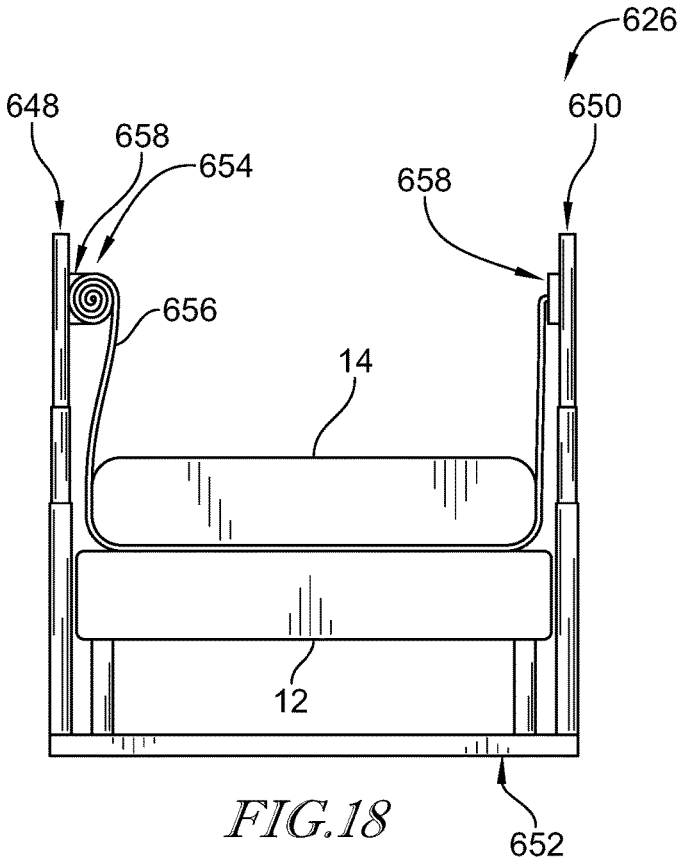
FIG. 18 is a front elevation and diagrammatic view of the elevation system of FIG. 17.

Another embodiment of an elevation system 626, in accordance with the present disclosure, is shown in FIGS. 17 and 18. The elevation system 626 is a mechanical elevation system 626 and includes a mount system 640 and an actuator system 642. The mount system 640 is configured to support the actuator system 642. The actuator system 642 is configured to raise and lower a movable section of the mattress 14.

The mount system 640 includes a head-section support 644 and a foot-section support 646 that is substantially similar to the head-section support 644 as shown in FIGS. 17 and 18. Each support 644, 646 includes a left rod 648 positioned on a left lateral side of the bed assembly, a right rod 650 positioned on a right lateral side of the bed assembly, and a connector rod 652 underlying the bed assembly. The left and right rods 648, 650 are configured to telescope upwardly and downwardly to accommodate bed assemblies of various heights. The connector rod 652 extends from the left rod 648 to the right rod 650 and rests on ground to support the left and right support rods 648, 650 in an upright, vertical position. The connector rod 650 may be configured to telescope transversely relative to the bed assembly to accommodate bed assemblies of various widths.

The actuator system 642 is coupled to the left and right support rods 648, 650 vertically above the mattress 14 and is configured to lift a movable section of the mattress 14 upwardly as shown in FIGS. 17 and 18. The actuator system 642 includes an actuator 654, a belt 656, and a mount 658. The actuator 654 is coupled to one of the support rods and is configured to actuate the belt 656 to decrease a length of the belt 656 and raise the movable section of the mattress 14. The belt 656 is arranged under the movable section of the mattress and is configured to raise and lower the movable section relative to the frame 12. The mount 658 secures the actuator 654 and the belt 656 to the left and right support rods 648, 650.

In the illustrative embodiment, the actuator 654 includes a manual hand crank 664 that may be turned to decrease a length of the belt 656 and raise the movable section of the mattress 14. However, in other embodiments, any suitable device may be used to actuate the belt 656 such as, for example, a powered motor.

Figure 19:
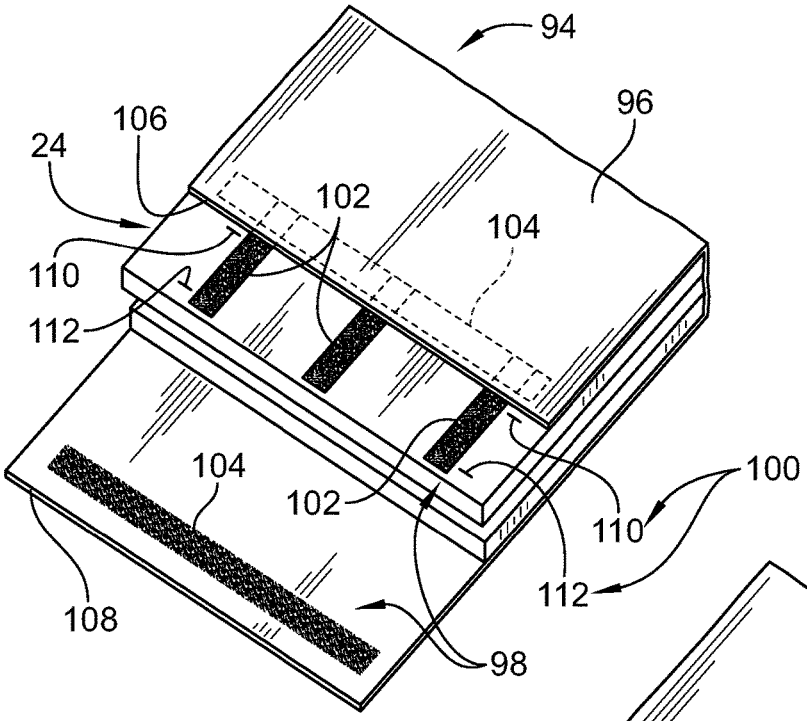
FIG. 19 is a perspective view of the elevation system of FIG. 1 including a cover.
Figure 20:
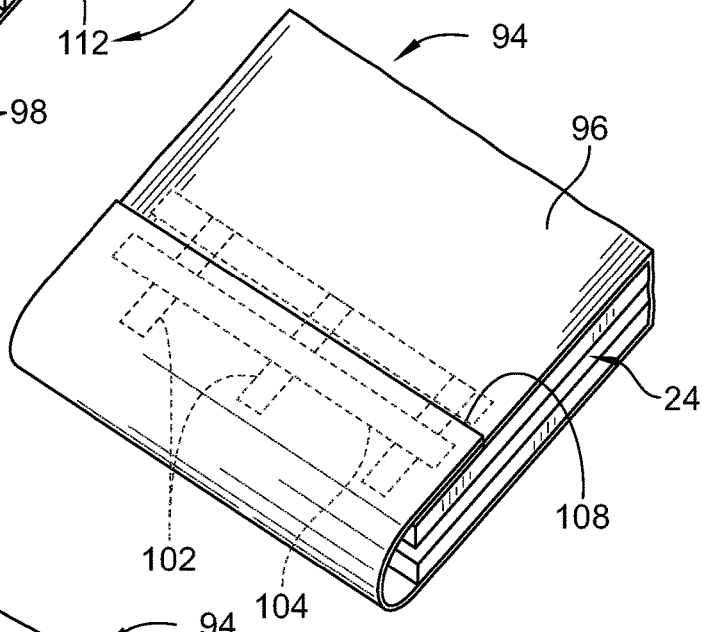
FIG. 20 is a perspective view of the elevation system of FIG. 1 showing the cover secured to the elevation system.
Figure 21:
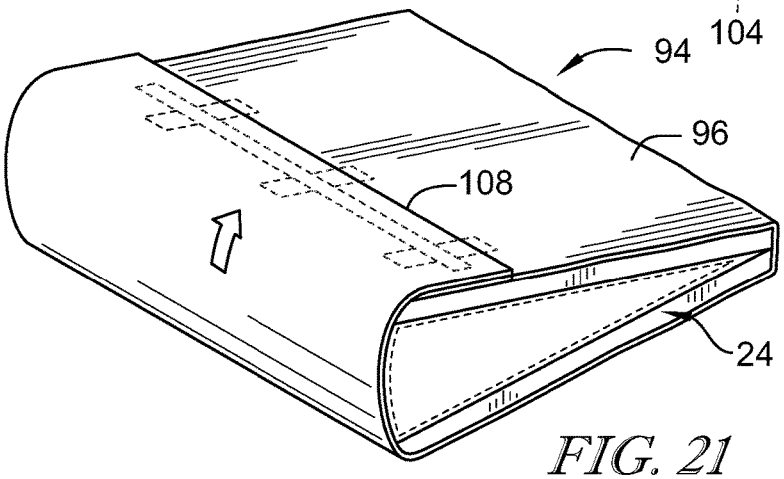
FIG. 21 is a perspective view of the elevation system of FIG. 1 showing the cover secured to the elevation system and the elevation system raised.

As previously described, the support system 24 may further include a cover 94 that may be used with any of the elevation systems 26, 226, 326, 426, 526, 626 previously described as shown in FIGS. 19-21. The cover 94 includes a sheet 96 and a retainer 98. The sheet 96 is wrapped around the support system 24 including the top plate 28, the base plate 30, and the hinge 32. The retainer 98 is coupled to the support system 24 and the sheet 96 and is configured to secure selectively the sheet 96 to the support system 24.

In the illustrative embodiment, the retainer 98 includes Velcro® strips coupled to the sheet 96 and the support system 24 as shown in FIG. 19. However, in other embodiments, other types of retainers or fasteners may be used such as, for example, mechanical fasteners, adhesives, or magnets. Three longitudinal strips 102 are coupled to the support system 24 while complementary transverse strips 104 are coupled to each end 106, 108 of the sheet 96. Each transverse strip 104 is coupled to the longitudinal strips 102 to retain the sheet 96 on the support system 24 as shown in FIG. 20.

The sheet 96 may be sized and/or located via the retainer 98 to restrict the elevation angle of the movable section of the mattress 14 by limiting the distance the top plate 28 may pivot relative to the base plate 30 about the hinge 32 as shown in FIG. 21. For example, in the illustrative embodiment shown in FIG. 19, indicator marks 100 are provided on the support system 24 adjacent to the longitudinal strips 104 of the retainer 98. The indicator marks 100 include a first set 110 associated with a first elevation angle of the movable section and a second set 112 associated with a second elevation angle of the movable section. The second end 108 of the sheet 96 may be aligned with the first set 110 to limit the elevation angle of the movable section to the first elevation angle. The second end 108 of the sheet 96 may be aligned with the second set 112 to limit the elevation angle of the movable section to the second elevation angle. The second elevation angle is greater than the first elevation angle due to increased spacing between the first and second ends of the sheet 96. Additional sets of indicator marks 100 may be provided to increase adjustability of the elevation angle of the movable section of the mattress 14 via the cover 94.

Figure 22:
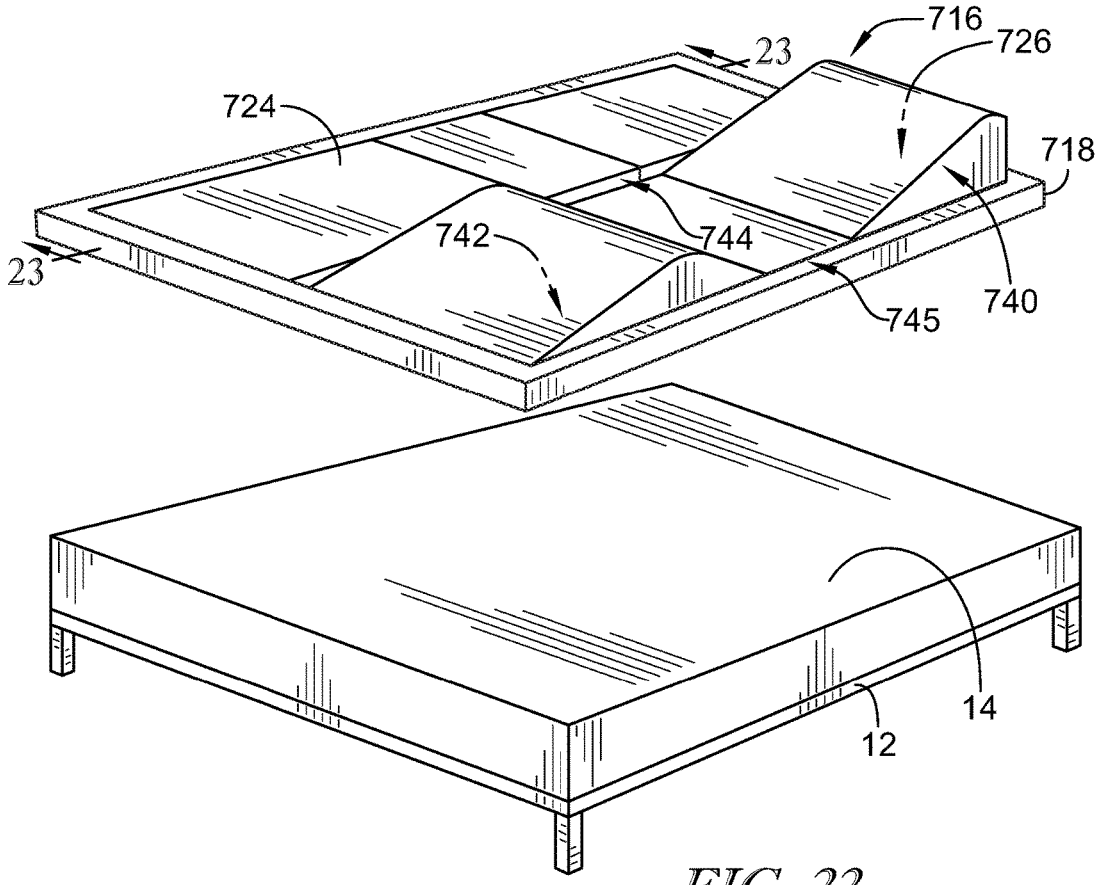
FIG. 22 is a perspective view of another bed assembly including an elevation system.
Figure 23:
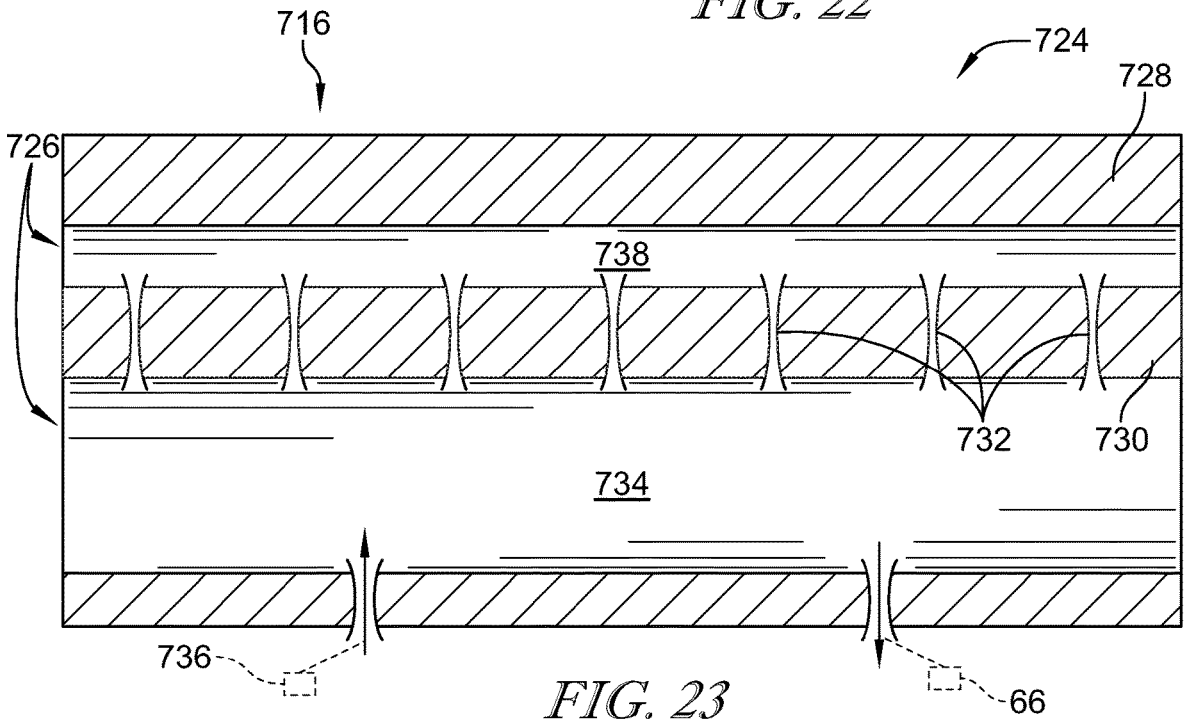
FIG. 23 is a sectional view of the elevation system of FIG. 22 taken along line 23-23 in FIG. 22.

Another embodiment of a patient-care system 716, in accordance with the present disclosure, is shown in FIGS. 22-23. The patient care system 716 is configured to transform a conventional bed assembly into the bed assembly 10 to provide one or more bed functions that a patient may need while being treated for various medical conditions at home. As such, the patient-care system 16 includes a mattress topper 718 that is configured to support a patient in multiple postures during at-home patient care. As previously described, the frame 12 and the mattress 14 illustratively provide a bed assembly that is used in a patient's home for personal uses. However, in other embodiments, the bed assembly 10 may be used in other settings such as, for example, a hospital, senior living/retirement homes, or any other suitable setting.

The mattress topper 718 is arranged to overlie the mattress 14 and includes one or more movable sections to provide elevation for various parts of the patient. The mattress topper 718 includes a pillow section 724 and an elevation system 726 that are configured to cooperate with the patient to provide elevation for a patient at a head section 20 and a foot section 22 of the mattress topper 716.

The pillow section 724 includes a pillow-top overlay 728 and a pillow midsection 730 as shown in FIG. 23. The pillow-top overlay 728 provides a comfortable surface for a patient. The pillow mid-section 730 is spaced apart from the pillow top overlay and is formed to include a plurality of channels 732 to communicate fluid between various bladders in the mattress topper 716 as will be explained in greater detail below.

The elevation system 726 includes a plurality of bladders formed in the mattress topper 716 and is configured to cooperate with the patient's body weight distribution to raise and lower the head section 20 and the foot section 22 of the mattress topper 716. The elevation system 726 includes a primary bladder 734 coupled to a fluid source 736 and a plurality of secondary bladders 738 as shown in FIGS. 22 and 23. The primary bladder 734 receives fluid from the fluid source 736 and provides the fluid to the secondary bladders 738 through the channels 732 depending on the patient' body weight distribution over the mattress topper 716. The secondary bladders 738 are configured to inflate and/or deflate in response to the patient's body weight distribution and an amount of fluid in the elevation system 726.

The plurality of secondary bladders 738 includes a head-section bladder 740, a foot-section bladder 742, and left and right side-bolster bladders 744, 745 as shown in FIG. 22. Each of the bladders 740, 742, 744, 745 are arranged in fluid communication with one another and the primary bladder 734 such that the patient may inflate and/or deflate one or more of the bladders in response to changing the patient's body weight distribution over the mattress topper 716 and/or changing the amount of fluid in the elevation system 724. In other embodiments, the secondary bladders 738 may be independent of one another and may include valves to regulate fluid flow into and out of each bladder 740, 742, 744, 745.

For example, the primary bladder 734 may be filled with fluid while the secondary bladders 738 contain no fluid. In this situation, the patient may be laid flat on the mattress topper 716. Additional fluid may be added to the primary bladder 734 from the fluid source 736. The added fluid may flow from the primary bladder 734, through the channels 732 and into one or more of the secondary bladders 738 depending on the patient's body weight distribution over the mattress topper 716. The patient may control or adjust the elevation of the bladders 740, 742, 744, 745 by changing his/her weight distribution.

The fluid source 736 may include fluid source 42, fluid source 54, or any other suitable fluid source. Additionally, the elevation system 726 may further include control system 66 to control input and output of fluid from the primary bladder 734.

Although this disclosure refers to specific embodiments, it will be understood by those skilled in the art that various changes in form and detail may be made without departing from the subject matter set forth in the accompanying claims.

The invention claimed is:

1. A bed assembly comprising:

a frame, a mattress supported by the frame, and a patient-care system including a support system and an elevation system insertable between the frame and the mattress, the elevation system and support system cooperating to move at least a portion of the mattress from a fully-lowered position, in which the mattress is arranged generally parallel to the frame, to a fully-raised position, in which the at least one movable section of the mattress is arranged at an angle relative to the frame, wherein the support system includes a top plate, a base plate, and a hinge positioned between a free end of the support system and a fixed end of the support system, and an elevation system coupled to the support system and configured to move the support system to raise the at least one movable section of the mattress in response to an activation of the elevation system, wherein the support system further includes a cover having a first end and a second end spaced apart from the first end at a predetermined distance so that a length of the cover corresponds to an elevation angle of the top plate relative to the base plate, wherein the cover includes a sheet defining the length of the cover and at least one retainer coupled to the support system to fix the cover to the support system at the predetermined distance, wherein the retainer includes longitudinal strips coupled to the support system and transverse strips coupled to the sheet, and a plurality of indicator marks are provided adjacent to the longitudinal strips, and wherein the indicator marks include a first set associated with a first angle of the mattress and a second set associated with a second angle of the mattress and the second end of the sheet is configured to align selectively with one of the sets to restrict the elevation angle of the mattress to one of the first and second angles associated with the first and second set and configured to prevent the at least one movable section of the mattress to be raised beyond the selected first or second angle.

2. The bed assembly of claim 1, wherein the elevation system includes at least one pneumatic bladder positioned between the top plate and the base plate and at least one valve coupled to the at least one pneumatic bladder.

3. The bed assembly of claim 2, wherein the elevation system further includes at least one pneumatic actuator coupled to the at least one pneumatic bladder and configured to change the at least one pneumatic bladder from a deflated state to and inflated state to move the movable section of the mattress towards the fully-raised position.

4. The bed assembly of claim 3, wherein the at least one pneumatic actuator includes a housing, a canister of fluid, and an activator, the housing defines an internal space and the canister is positioned in the internal space and coupled to the pneumatic bladder with a conduit such that the canister is configured to release the fluid into the pneumatic bladder in response to triggering the activator.

5. The bed assembly of claim 3, wherein the pneumatic actuator is a manual hand pump.

6. The bed assembly of claim 3, wherein the pneumatic actuator is an automatic air-pump.

7. The bed assembly of claim 2, wherein the bladder has a sheet that defines an internal space and the elevation system further includes a foam insert positioned within the internal space of the bladder and the foam insert is configured to apply an outward force on the sheet to expand the bladder to the inflated state.

8. The bed assembly of claim 7, wherein the elevation system includes an inlet valve, an outlet value, and a valve cap configured to cover the outlet valve, and the inlet valve and the outlet valve are both one way valves such that the bladder is configured to remain inflated while the valve cap covers the outlet valve.

9. The bed assembly of claim 8, wherein the bladder is configured to deflate when the valve cap is removed from the outlet valve and a force is applied to the bladder and the foam insert to compress the foam insert.

10. The bed assembly of claim 2, wherein the elevation system includes a plurality of bladders each having a sheet that defines an internal space and plurality of foam inserts, at least one foam insert is positioned within the internal space of the bladders, and wherein each foam insert is configured to apply an outward force on the bladders to expand each bladder to the inflated state.

11. The bed assembly of claim 10, wherein the elevation system further includes at least one fastener between adjacent bladders to couple each of the bladders together.

12. The bed assembly of claim 2, wherein the elevation system includes a first pneumatic pump coupled to a first pneumatic bladder in a head section of the mattress and a second pneumatic pump coupled to a second pneumatic bladder in a foot section of the mattress, and the at least one valve is configured to open to manually release air contained within at least one of the pneumatic bladders.

13. The bed assembly of claim 2, wherein the elevation system includes a single pneumatic pump coupled to a first pneumatic bladder in a head section of the mattress and a second pneumatic bladder in a foot section of the mattress, and a first valve is configured to selectively switch between the first and second pneumatic bladders to inflate one of the first and second pneumatic bladders while a second valve is configured to open to manually release air contained within at least one of the pneumatic bladders.

14. The bed assembly of claim 2, wherein the bed assembly further includes a control panel and the elevation system includes a first pneumatic pump coupled to a first pneumatic bladder in a head section of the mattress and a second pneumatic pump coupled to a second pneumatic bladder in a foot section of the mattress, and a first valve is configured to open to manually deflate the first bladder upon activation of a first button on the control panel and a second valve is configured to open to manually deflate the second bladder upon activation of a second button on the control panel.

15. The bed assembly of claim 2, wherein the elevation system further includes a release system coupled to the pneumatic bladder, and wherein the valve is configured to allow fluid to flow out of the bladder at a first flowrate and the release system is configured to allow fluid to flow out of the bladder at a second flowrate, and the second flowrate is greater than the first flowrate.

16. The bed assembly of claim 15, wherein the release system includes a plug coupled to the pneumatic bladder and a cord having a first end coupled to the plug and a second end coupled to a pull tab.

17. The bed assembly of claim 1, wherein the cover is configured to retain the top plate at the elevation angle to position the movable section of the mattress in the fully-raised position.

* * * * *